US006293853B1

(12) United States Patent
Perlov et al.

(10) Patent No.: US 6,293,853 B1
(45) **Date of Patent: *Sep. 25, 2001**

(54) CONDITIONER APPARATUS FOR CHEMICAL MECHANICAL POLISHING

(75) Inventors: Ilya Perlov; Eugene Gantvarg, both of Santa Clara, CA (US)

(73) Assignee: Applied Materials, Inc., Santa Clara, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/479,046

(22) Filed: Jan. 7, 2000

Related U.S. Application Data

(63) Continuation of application No. 08/890,781, filed on Jul. 11, 1997, now Pat. No. 6,036,583.

(51) Int. Cl.[7] ..... B24B 1/00

(52) U.S. Cl. ..... 451/56; 451/288; 451/443; 451/450

(58) Field of Search ..... 451/56, 288, 443, 451/450, 286, 289, 290, 444

(56) References Cited

U.S. PATENT DOCUMENTS

| | | | |
|---|---|---|---|
| 5,216,843 | 6/1993 | Breivogel et al. . | |
| 5,245,796 | 9/1993 | Miller et al. . | |
| 5,308,438 | 5/1994 | Cote et al. . | |
| 5,456,627 | 10/1995 | Jackson et al. . | |
| 5,486,131 | 1/1996 | Cesna et al. . | |
| 5,531,635 * | 7/1996 | Mogi et al. | 451/72 |
| 5,626,509 | 5/1997 | Hayashi . | |
| 5,643,067 * | 7/1997 | Katsuoka et al. | 451/444 |
| 5,833,519 | 11/1998 | Moore . | |
| 6,036,583 * | 3/2000 | Perlov et al. | 451/56 |

FOREIGN PATENT DOCUMENTS

| | | |
|---|---|---|
| 0 770 455 A1 | 5/1997 | (EP) . |
| 0 774 323 A2 | 5/1997 | (EP) . |

* cited by examiner

*Primary Examiner*—Joseph J. Hail, III
*Assistant Examiner*—George Nguyen
(74) *Attorney, Agent, or Firm*—Fish & Richardson

(57) ABSTRACT

In one aspect, an apparatus and a method for use in substrate polishing are described wherein a conditioner head is provided for receiving an end effector for conditioning a polishing pad surface; the conditioner head is supported above the polishing pad surface to be conditioned; and the conditioner head is driven with an actuating force from a position that lies along a line that is substantially normal to the polishing pad surface to be conditioned so that an end effector attached to the conditioner head can condition the surface of the polishing pad. In another aspect, pneumatic pressure is supplied through the conditioner head support arm to apply actuating force to the conditioner head so that an end effector attached to the conditioner head can condition the surface of the polishing pad. In yet another aspect, the conditioner head support arm has a fluid channel extending therein and a fluid port, wherein the fluid channel is constructed to receive rinsing fluid and fluid port is constructed to direct rinsing fluid from the fluid channel toward the polishing pad surface to be conditioned.

15 Claims, 7 Drawing Sheets

10
50
48
42
18
46
44
20
57
62
56
75
73
71
64
60
66
14
54
58
52
16

CONDITIONER APPARATUS FOR CHEMICAL MECHANICAL POLISHING

This application is a con't of Ser. No. 08/890,781 filed Jul. 11, 1997, now U.S. Pat. No. 6,036,583.

BACKGROUND OF THE INVENTION

The invention relates to substrate polishing techniques, including chemical mechanical polishing (CMP).

Chemical mechanical polishing is a process by which a substrate surface is smoothed (planarized) to a uniform level by a polishing pad and an abrasive slurry. A substrate to be polished is usually mounted on a rotatable carrier head and pressed against a rotating polishing pad. The polishing pad typically consists of a disk with a roughened surface. An abrasive chemical solution (slurry) is deposited onto the polishing pad to achieve a desired substrate surface finish. Over time, the polishing process glazes the polishing pad and creates irregularities in the polishing pad surface that can adversely affect the substrate surface finish. The polishing pad surface is typically "conditioned," whereby the polishing pad surface is deglazed and surface irregularities are removed, by scouring the polishing pad surface with an abrasive device known as an end effector.

SUMMARY OF THE INVENTION

In one aspect, the invention features an apparatus and a method for use in substrate polishing according to which a conditioner head is provided for receiving an end effector; the conditioner head is supported above the polishing pad surface to be conditioned; and the conditioner head is driven with an actuating force from a position that lies along a line that is substantially normal to the polishing pad surface to be conditioned so that an end effector attached to the conditioner head can condition the surface of the polishing pad.

In another aspect, the invention features an apparatus and a method for use in substrate polishing according to which pneumatic pressure is supplied through the conditioner head support arm to apply actuating force to the conditioner head so that an end effector attached to the conditioner head can condition the surface of the polishing pad.

In yet another aspect, the invention features an apparatus and a method for use in substrate polishing according to which the conditioner head support arm has a fluid channel extending therein and a fluid port, wherein the fluid channel is constructed to receive rinsing fluid and fluid port is constructed to direct rinsing fluid from the fluid channel toward the polishing pad surface to be conditioned.

Embodiments may include one or more of the following features. The conditioner may be supported above the polishing pad surface by a support arm, and an actuating force may be applied to the conditioner head by a driver. The driver may apply to the conditioner head actuating force that lies along a line that is substantially normal to the polishing pad surface to be conditioned. The driver may comprise a drive shaft coupled between the conditioner head and the support arm, and the drive shaft may be linearly actuatable toward and away from the polishing pad to be conditioned along a drive shaft axis that is substantially normal to the polishing pad surface. The driver may comprise a fluid membrane coupled between the drive shaft and an interior cavity, wherein the fluid membrane seals fluid within the interior cavity of the support arm as the drive shaft is linearly actuated. The drive shaft may be constructed to rotate the conditioner head. A gimbal mechanism may be coupled between the drive shaft and the conditioner head to allow the conditioner head to rotate and to tilt at an angle relative to the drive shaft axis. The support arm may have another end coupled to a base that is constructed to move the conditioner head over the polishing pad surface to be conditioned.

When a driving force is applied to a conditioner head from a position that does not lie along a line that is normal to a polishing pad surface, the driving force and the responsive normal force may result in the generation of torque that tends to raise the conditioner head off the polishing pad surface; such a torque may lead to instability and thereby reduce the ability to uniformly apply force against polishing pad surface. By driving the conditioner head with an actuating force from a position that lies along a line which is substantially normal to a polishing pad surface, in accordance with one aspect of the invention, the normal force and the driving force both lie along the same line and little or no torque is generated. The invention therefore allows force to be controllably and stably applied against a polishing pad surface, improving the uniformity with which a polishing pad surface can be conditioned and thereby improving the overall polishing process. Supplying rinsing fluid to the polishing pad surface through the support arm, in accordance with another aspect of the invention, allows the overall size of the polishing apparatus to be reduced and improves the ability to control the delivery of rinsing fluid.

Other features and advantages will become apparent from the following description, including the drawings and the claims.

DESCRIPTION OF THE PREFERRED EMBODIMENTS

Figure 1A:
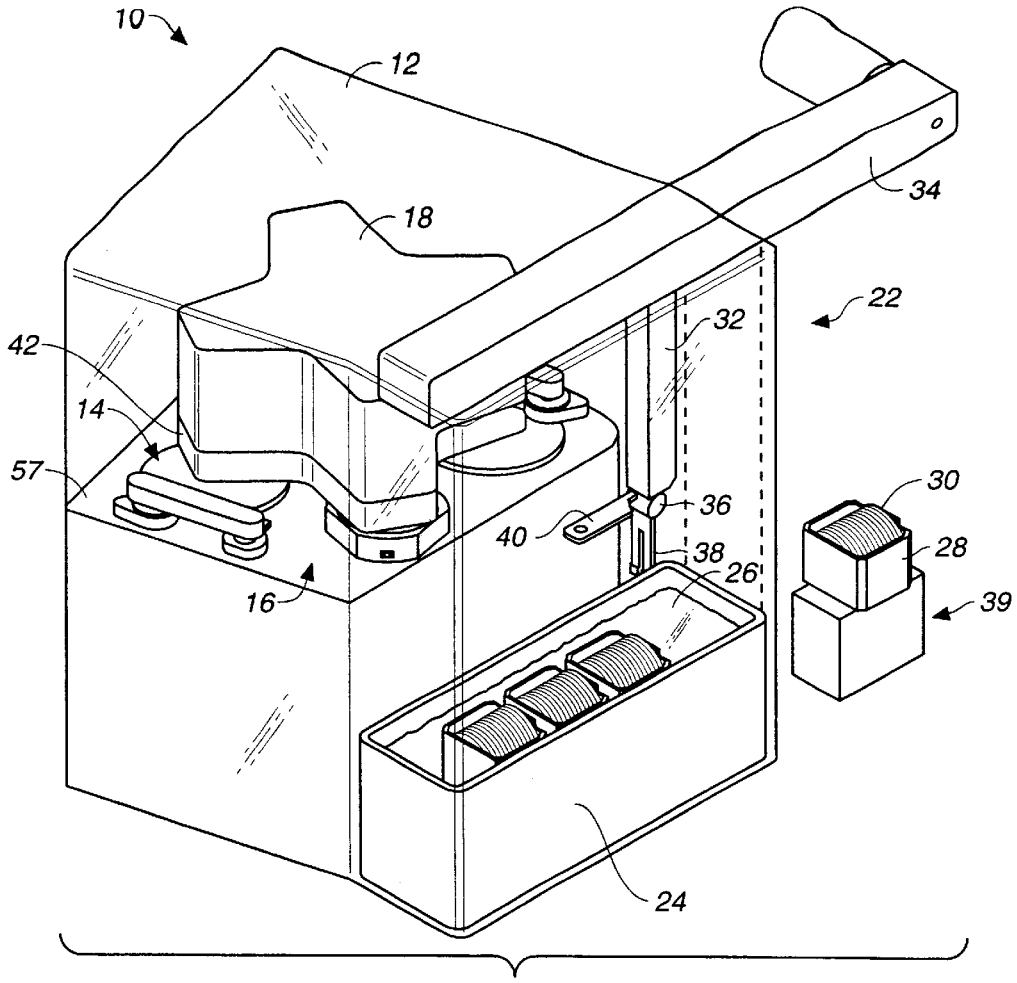
FIG. 1A is a perspective view of a polishing apparatus.
Figure 1B:
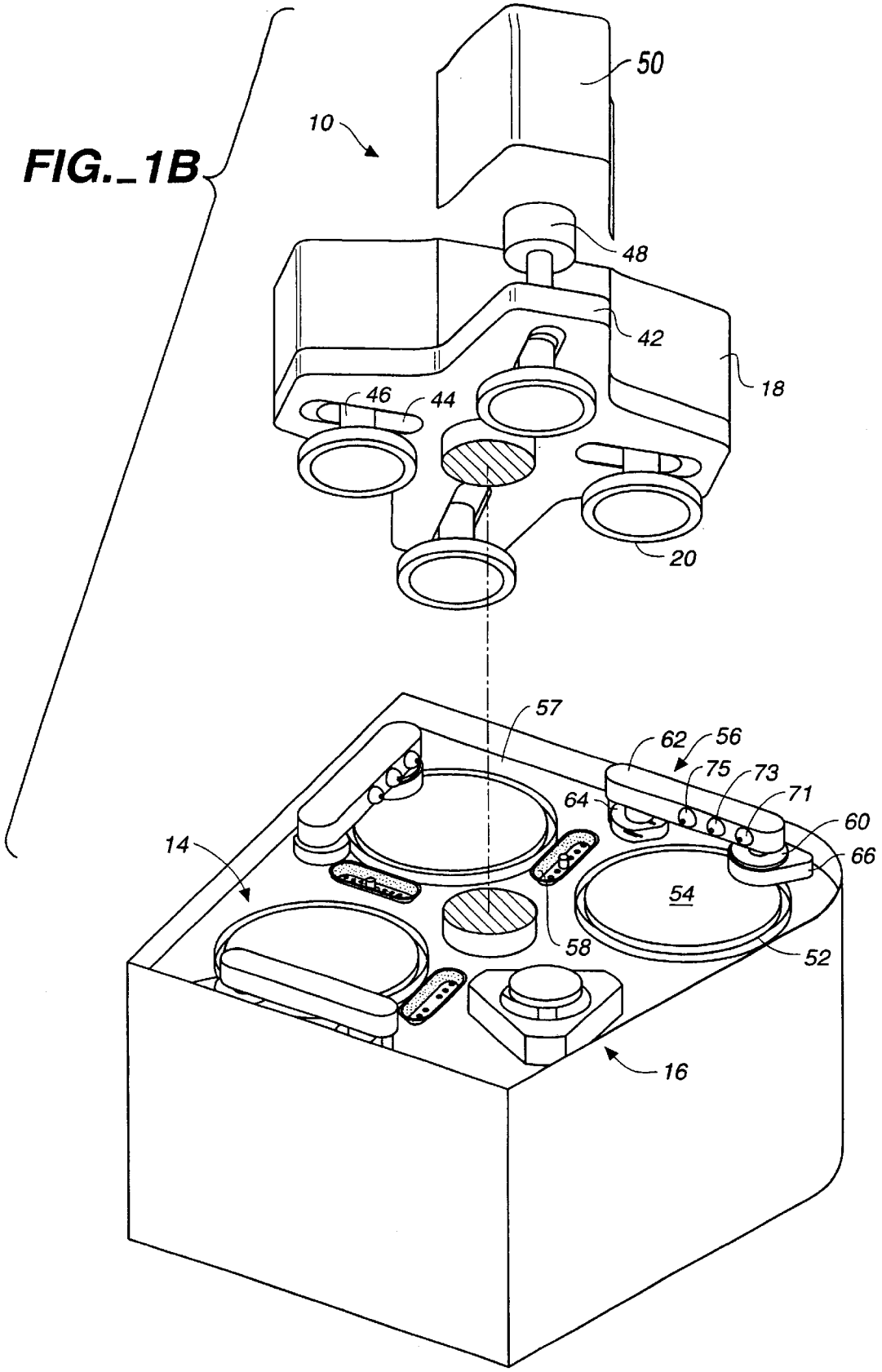
FIG. 1B is an exploded view of the polishing apparatus of FIG. 1.

Referring to FIGS. 1A and 1B, a polishing apparatus 10 includes a housing 12 that contains three independently-operated polishing stations 14, a substrate transfer station 16, and a rotatable carousel 18 which choreographs the operation of four independently rotatable carrier heads 20. Attached to one side of housing 12 is a substrate loading apparatus 22 that includes a tub 24 that contains a liquid bath 26 in which cassettes 28 of substrates 30 are immersed before polishing. An arm 32 rides along a linear track 34 and supports a wrist assembly 36, which includes a cassette claw 38 for moving cassettes 28 from a holding station 39 into tub 24 and a substrate blade 40 for transferring substrates from tub 24 to transfer station 16.

Carousel 18 has a support plate 42 with slots 44 through which shafts 46 of carrier heads 20 extend. Carrier heads 20 can independently rotate and oscillate back-and-forth in slots 44 to achieve a uniformly polished substrate surface. Carrier heads 20 are rotated by respective motors 48, which are normally hidden behind removable sidewalls 50 of carousel 18. In operation, a substrate is loaded from tub 24 to transfer station 16, from which the substrate is transferred to a carrier head 20; carousel 18 then transfers the substrate through a series of one or more polishing stations 14 and finally returns the polished substrate to transfer station 16.

Each polishing station 14 includes a rotatable platen 52, which supports a polishing pad 54, and a pad conditioner 56; platen 52 and conditioner 56 are both mounted to a tabletop 57 inside polishing apparatus 10. Each pad conditioner 56 includes a conditioner head 60, an arm 62, and a base 64 for positioning conditioner head 60 over the surface of a polishing pad 54 to be conditioned. Each polishing station 14 also includes a cup 66, which contains a fluid for rinsing conditioner head 60.

Figure 2A:
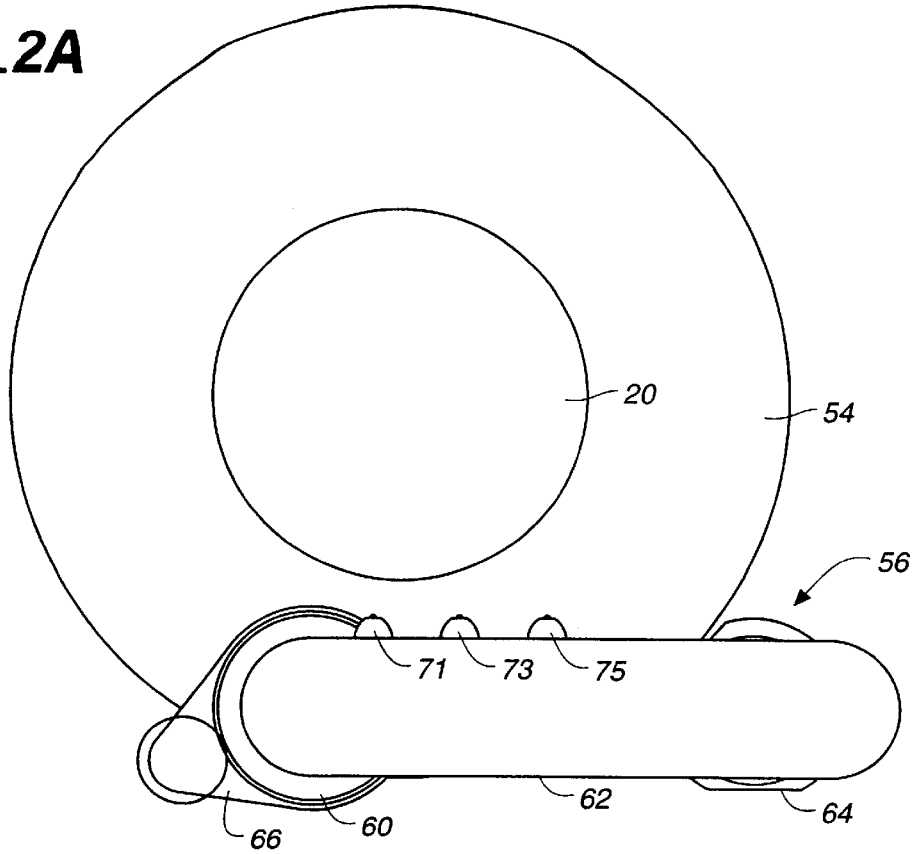
FIGS. 2A and 2B are diagrammatic top views of a substrate being polished and a polishing pad being conditioned by the polishing apparatus of FIG. 1.
Figure 2B:
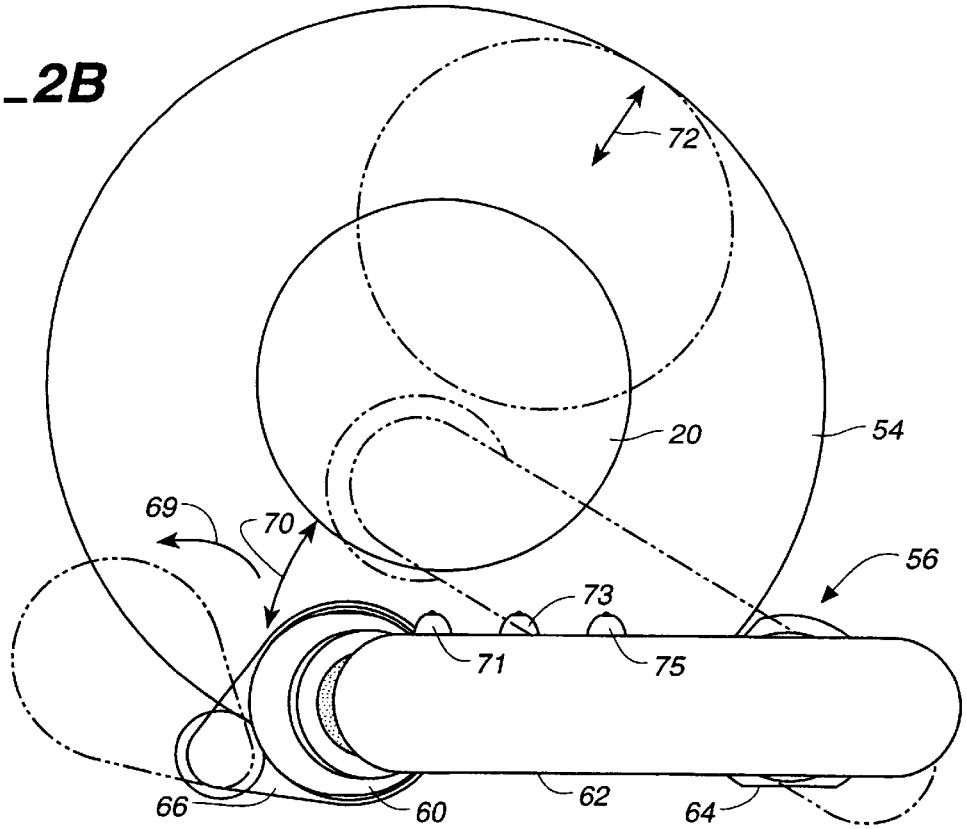

Referring to FIGS. 2A and 2B, in one mode of operation, polishing pad 54 is conditioned by pad conditioner 56 while polishing pad 54 polishes a substrate which is mounted on carrier head 20. Conditioner head 60 sweeps across polishing pad 54 with a motion that is synchronized with the motion of carrier head 20 across polishing pad 54. For example, a carrier head 20 with a substrate to be polished may be positioned in the center of polishing pad 54 and conditioner head 60 may be immersed in a rinsing fluid contained within cup 66. During polishing, cup 66 may pivot out of the way as shown by arrow 69, and conditioner head 60 carrying a substrate may be swept back-and-forth across polishing pad 54 as shown by arrows 70 and 72, respectively. Three water jets 71, 73, and 75 may direct streams of water toward polishing pad 54 to rinse slurry from the pad surface.

For further details regarding the general features and operation of polishing apparatus 10, please refer to co-pending application Ser. No. 08/549,336, filed, Oct. 27, 1995, by Perlov et al., entitled "Continuous Processing System for Chemical Mechanical Polishing," and assigned to the assignee of the present invention, which is herein incorporated by reference.

Figure 3A:
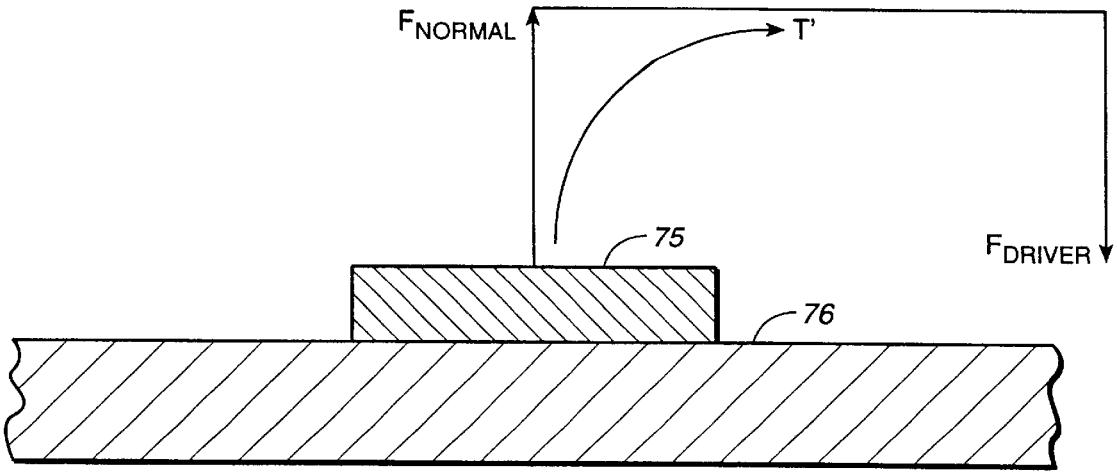
FIG. 3A is a diagrammatic view of a driver applying force to a conditioner head from a position that does not lie along a line that is normal to a polishing pad surface.
Figure 3B:
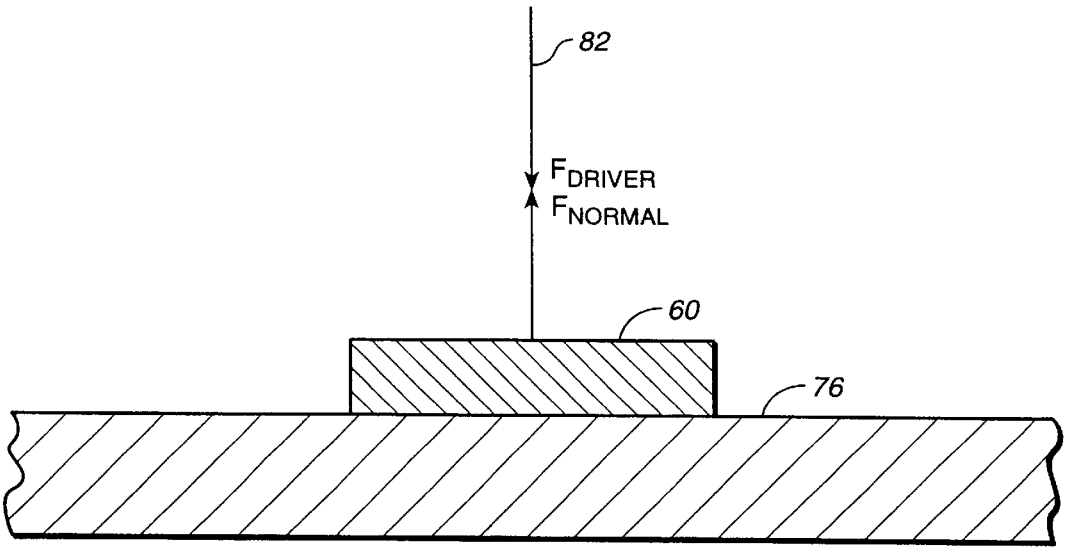
FIG. 3B is a diagrammatic view of a driver applying force to a conditioner head from a position that lies along a line that is normal to a polishing pad surface.

Referring to FIG. 3A, it has been realized that when a driving force ($F_{driver}$) is applied to a conditioner head 75 from a position that does not lie along a line that is normal to a polishing pad surface 76, the driving force and the responsive normal force ($F_{normal}$) result in a counterclockwise torque (T') that tends to raise conditioner head 75 off polishing pad surface 76. Such torque generation may lead to instability and thereby reduce the ability to controllably apply force against polishing pad surface 76. As shown in FIG. 3B, when, in accordance with one aspect of the invention, actuating force is applied to conditioner head 60 from a position that lies along a line 82 which is substantially normal to polishing pad surface 76, the normal force and the driving force both lie along the same line 82 and little or no torque is generated. The invention therefore allows force to be controllably and stably applied against polishing pad surface 76, improving the uniformity with which a polishing pad surface can be conditioned and thereby improving the overall polishing process.

Figure 4D:
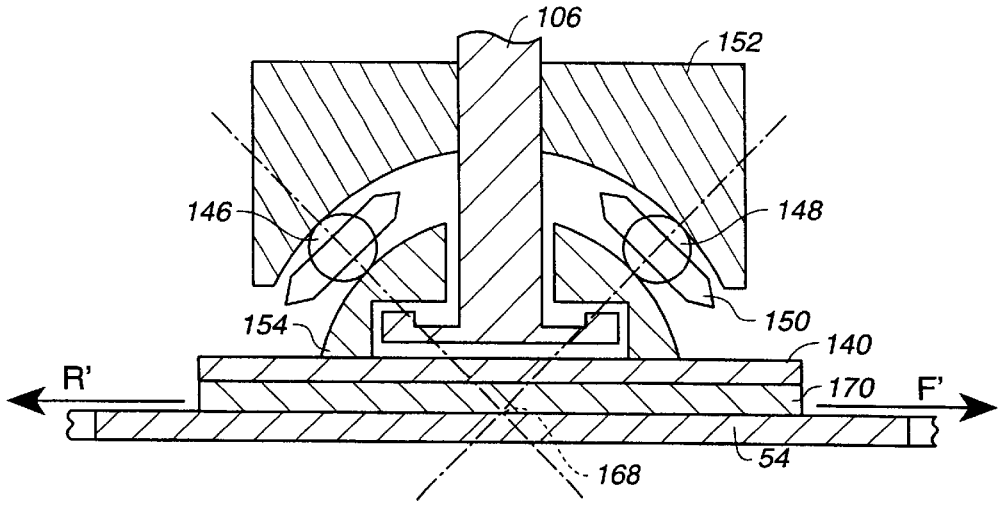
FIG. 4D is diagrammatic side view of gimbal mechanism coupling the carrier head to a conditioner drive shaft in the polishing pad conditioner of FIG. 4A.
Figure 4A:
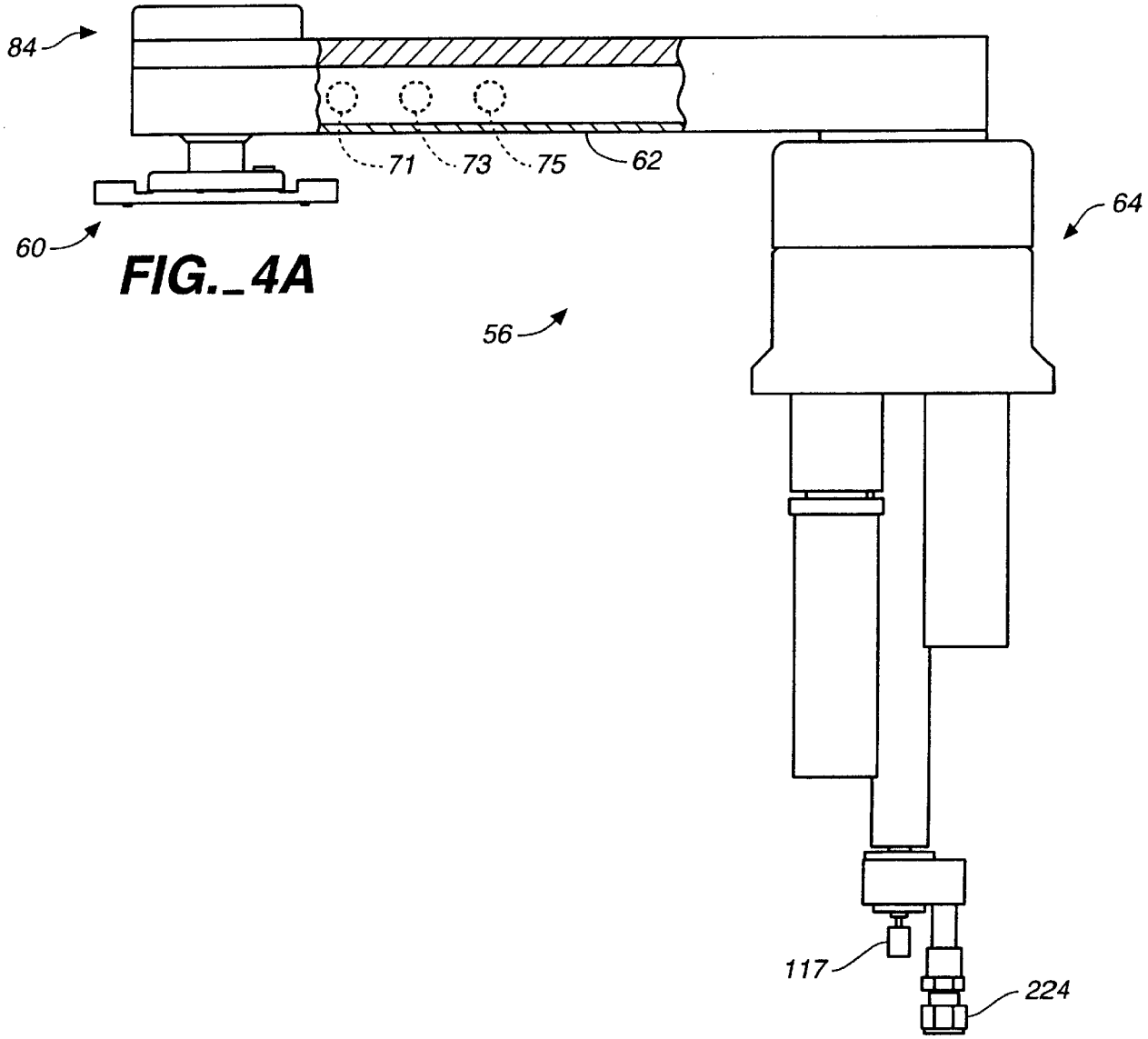
FIG. 4A is a diagrammatic side view of a polishing pad conditioner which includes a carrier head in an extended position.
Figure 4B:
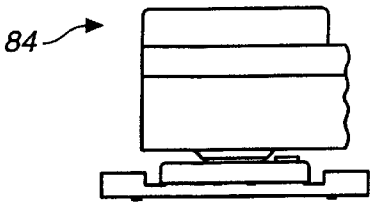
FIG. 4B is a diagrammatic side view of a portion of the polishing pad conditioner of FIG. 4A with the carrier head in a retracted position.

Referring to FIGS. 4A and 4B, support and 62 of pad conditioner 56 has one end coupled to conditioner head 60 and another end coupled to base 64, which sweeps conditioner head 60 across a polishing pad surface. A driver 84 couples conditioner head 60 to arm 62 and drives conditioner head 60 between an extended position (FIG. 4A) and a retracted position (FIG. 4B). As explained above, driver 84 applies an actuating force to conditioner head 60 from a position that lies along a line that is substantially normal to the polishing pad surface to be conditioned, so as to significantly reduce the amount of torque generated in polishing pad conditioner 56.

Figure 4C:
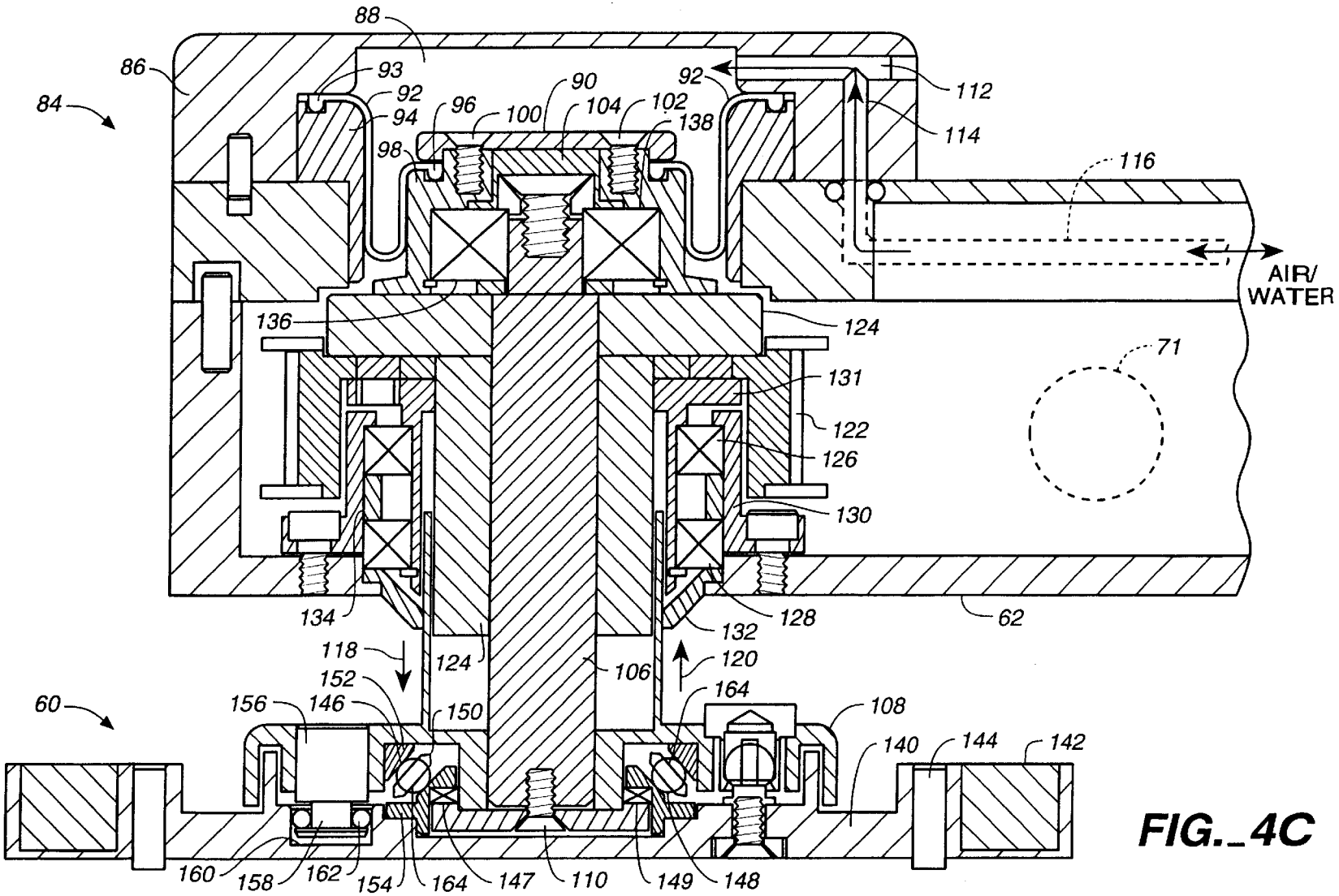
FIG. 4C is a diagrammatic side view of the carrier head of the polishing pad conditioner of FIG. 4A.

Referring to FIG. 4C, driver 84 includes a housing 86 that defines an interior portion of a fluid cavity 88. Fluid cavity 88 is further defined by a face plate 90 and a fluid membrane 92, which is made of neoprene rubber with, for example, a hardness of about 40 durometer and a thickness of about 0.03 inch. Fluid membrane 92 has one end 93 that is attached to housing 86 by an annular clamp 94 and another end 96 that is attached to face plate 90 by an annular clamp 98 which is coupled to face plate 90 by bolts 100, 102. A flange 104 couples face plate 90 to a spline shaft 106 which is, in turn, coupled to a flange 108 of conditioner head 60 by a bolt 110. In operation, fluid cavity 88 receives pressurized air through fluid channels 112 and 114 defined in driver housing 86 and through a fluid channel 116 which extends through and 62 and through base 64 to an inlet port 117 (FIG. 4A). The build-up of air pressure inside fluid cavity 88 drives face plate 90, spline shaft 106, and conditioner head 60 in the direction indicated by arrow 118. As air is evacuated from fluid cavity 88, the reduction in air pressure in fluid cavity 88 causes face plate 90, spline shaft 106, and conditioner head 60 to retract in the direction indicated by arrow 120.

Fluid channel 116 includes separate tubes for respectively receiving air and a rinsing solution, such as water. The rinsing solution tube is coupled to waterjets 71, 73, and 75 located along aim 62 (see FIGS. 2A, 2B, and 4A). The rinsing solution may be used to rinse a polishing pad surface before, during, or after polishing to prevent the build-up of slurry deposits.

Driver 84 also includes a toothed sheave 122 which is coupled to a spline nut 124. Toothed sheave 122 and spline nut 124 are rotated by a toothed drive belt (not shown) which is driven by a motor in base 64 (discussed in detail below). Spline nut 124 engages spline shaft 106 and thereby causes spline shaft 106 and conditioner head 60 to rotate when driven by the drive belt. A pair of annular bearings 126, 128 are held in place between arm 62 and spline nut 124 by an upper collars 130, 131 and a lower collar 132; annular bearings 126, 128 are spaced apart by an annular spacer 134. Annular bearings 126, 128 allow spline nut 124 to rotate freely with respect to an 62. A pair of bearings 136, 138 allow spline nut 124 and spline shaft 106 to rotate freely with respect to face plate 90.

Conditioner head 60 includes a face plate 140 which has an annular magnet 142 for holding in place an end effector (not shown) which is used to condition a surface of a polishing pad; pins 144 are used to engage and thereby transfer torque to an end effector held to face plate 140. Face plate 140 and flange 108 are coupled together by a gimbal mechanism which includes a plurality of ball bearings 146, 148 seated within holes in an annular cage 150 and positioned between an upper annular race 152 and a lower annular race 154. Ball bearings 146, 148 and springs 147, 149 allow face plate 140 to mutate with respect to spline shaft 106. The degree of nutation is limited by three torque transfer pins 156 which are mounted to flange 108 (only one torque transfer pin is shown in FIG. 4B). Torque transfer pins 156 have protrusions 158 which extend into recesses 160 in face plate 140 and transfer rotational forces from flange 108 to face plate 140. Each protrusion 158 includes an o-ring 162 with a hardness of about 40 durometer that limits the degree of nutation between face plate 140 and flange 108. Although limited, this nutation allows face plate 140 to accommodate small features on the surface of a polishing pad so that one side of face plate 140 does not polish with greater force than another.

Referring to FIG. 4D, the gimbal mechanism is constructed so as to substantially reduce non-uniform conditioning of a surface of polishing pad 54. The ball-and-socket joint created by ball bearings 146, 148 and upper and lower races 152, 154 is constructed so that the spherical center of symmetry 168 coincides with the center of frictional torque (F') generated between an end effector 170 attached to conditioner head 60 and a polishing pad. The effective rotational center 168 is the point around which, when the compression and varying lateral consistency of the polishing pad and the end effector are taken into account, the rotational frictional forces between the polishing pad and the end effector produce substantially no net torque in the vertical direction relative to center point 168. That is, the gimbal mechanism is constructed so that the resultant force (R') needed to drag conditioner head 60 across a polishing pad appears in the plane at the interface between conditioner head 60 and the polishing pad; this is the same plane that contains the resultant frictional force (F') between conditioner head 60 and the polishing pad. The resulting net torque generated between conditioner head 60 and the polishing pad is thereby substantially reduced because the resultant dragging force (R') and the resultant frictional force (F') lie in substantially the same plane, with little or no moment arm separating these resultant forces. This construction substantially reduces the tendency of the conditioner head to rotate which would otherwise cause conditioner head 60 to apply polishing pressure nonuniformly across polishing pad 54.

Figure 4E:
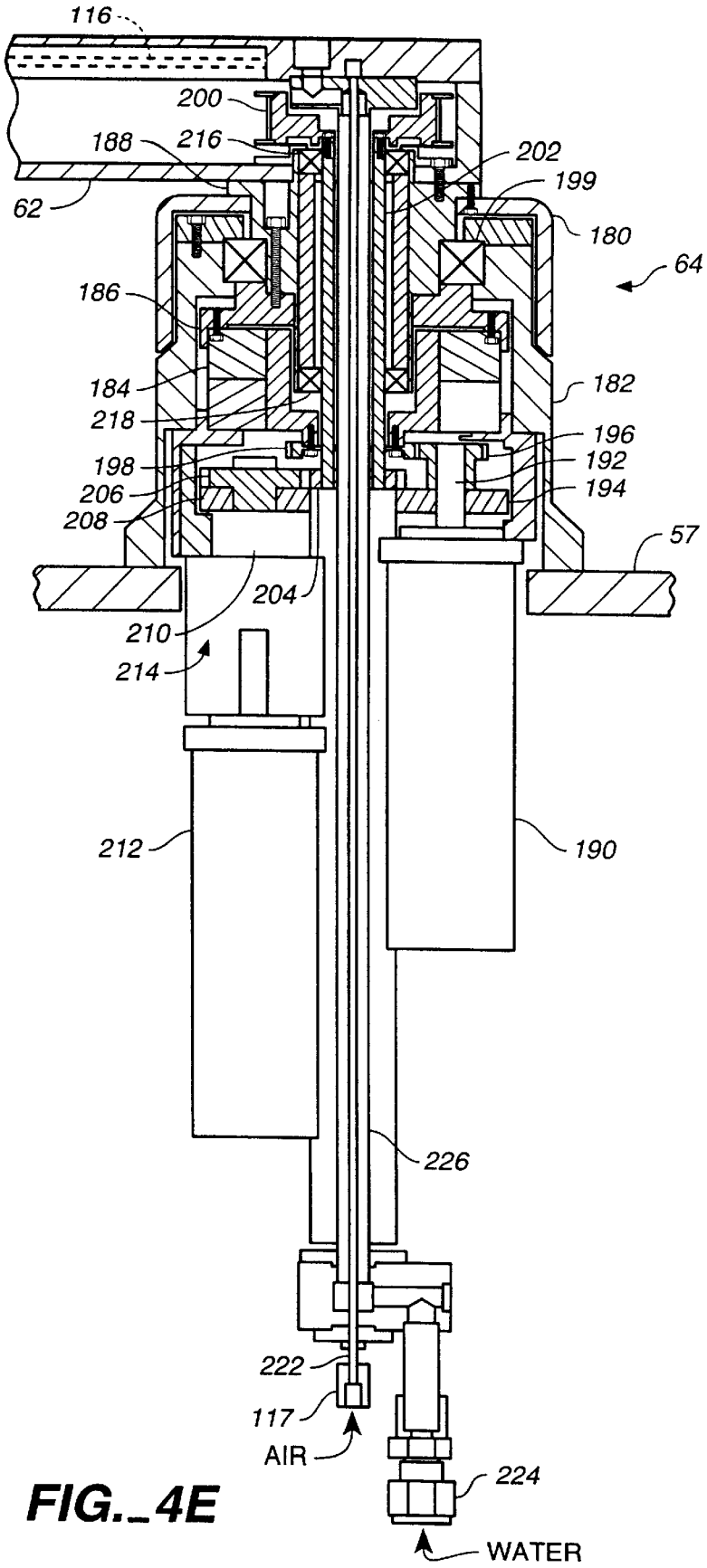
FIG. 4E is a diagrammatic side view of the base of the polishing pad conditioner of FIG. 4A.

Referring to FIG. 4E, base 64 includes a pivot support plate 180, which is attached to arm 62, and a motor bracket 182, which is mounted onto tabletop surface 57. Motor bracket 182 is attached to a harmonic drive 184 (e.g., a harmonic drive available from Harmonic Drive Technologies, Teijin Seiki Boston, Inc. of Peabody, Mass.). The high-speed, low-torque side of harmonic drive 184 is fixed to motor bracket 182, and the low-speed, high-torque side is fixed by flanges 186, 188 to pivot support plate 180 and arm 62. A drive sweep motor 190 is mounted to motor bracket 182 underneath tabletop 57. Drive sweep motor 190 has a drive shaft 192 which is coupled by a clamp 194 to a gear 196 that engages with a rim drive gear 198 of harmonic drive 184. In operation, drive sweep motor 190 drives harmonic drive 184 which, in turn, rotates pivot support plate 180, thereby sweeping arm 62 back-and-forth across a surface of a polishing pad. Bearings 199 allow pivot support plate 180 to rotate freely with respect to motor bracket 182.

As mentioned above with respect to FIG. 4C, conditioner head 60 is rotated by driving spline shaft 106 and spline nut 124 with a toothed sheave 122 that engages with a toothed drive belt at one end of arm 62. At the other end of arm 62, shown in FIG. 4D, the toothed drive belt (not shown) engages with a corresponding toothed sheave 200 which is coupled to one end of a drive shaft 202. The other end of drive shaft 202 has a gear 204, which engages with a gear 206 coupled by a clamp 208 to a motor drive shaft 210 of a conditioner motor 212. Gears 204, 206 are contained within a gear housing 214 that is fixed to tabletop 57. Rotation of motor drive shaft 210 drives shaft 202 which, in turn, rotates toothed sheave 122 and thereby rotates conditioner head 60. Bearings 216, 218 enable drive shaft 202 to rotate freely with respect to pivot support plate 180 and motor bracket 182.

Air is introduced into and evacuated from pad conditioner 56 through a pneumatic input 117 that is coupled to an inner tube 222 which extends through drive shaft 202 and connects with fluid channel 116. Fluid, such as water, used to rinse an end effector attached to conditioner head 60 is introduced into pad conditioner 56 through a fluid input 224 which is coupled to an annular channel defined between the outer surface of inner tube 222 and the interior surface of an outer tube 226.

Polishing pad conditioner 56 can be used in a number of different ways. For example, pad conditioner 56 may be controlled by a software program running on a computer. A polishing pad can be conditioned before, during or after a substrate is polished. A variety of end effectors may also be used. In general, an end effector includes an abrasive surface, such as a diamond-impregnated surface, that is pressed against a polishing pad to deglaze the pad and remove any surface irregularities. The abrasive surface may have teeth or recesses depending upon the desired substrate surface finish. An end effector may have an adhesive surface for attaching the end effector to the conditioner head.

Other embodiments are within the scope of the claims.

What is claimed is:

1. An apparatus for use in substrate polishing, comprising:

a conditioner head constructed to receive an end effector for conditioning a surface of a polishing pad; and a support arm for supporting the conditioner head above the polishing pad surface to be conditioned, the support and having a fluid channel extending essentially longitudinally therein and a fluid port, wherein the fluid channel is constructed to receive rinsing fluid and the fluid port is constructed to direct rinsing fluid from the fluid channel toward the polishing pad surface to be conditioned.

2. The apparatus of claim 1, wherein the fluid channel comprises a tube for receiving the rinsing fluid and a tube for receiving air.

3. The apparatus of claim 2, wherein the tube for receiving the rinsing fluid is coupled to one or more water jets.

4. The apparatus of claim 1, wherein the support arm is coupled to a base and the fluid channel extends through the base.

5. The apparatus of claim 1, wherein the fluid channel is constructed to supply air to a fluid cavity, wherein the build-up and release of air pressure within the fluid cavity extends and retracts the conditioner head toward and away from the polishing pad surface to enable the end effector to condition the surface of the polishing pad.

6. The apparatus of claim 1, wherein the end effector includes a diamond-impregnated surface.

7. The apparatus of claim 1, wherein a surface of the end effector includes teeth.

8. The apparatus of claim 1, wherein a surface of the end effector includes recesses.

9. An apparatus for use in substrate polishing, comprising:

a conditioner head constructed to receive an end effector for conditioning a surface of a substrate polishing pad;

a support arm extending horizontally over the surface of the polishing pad and having one end coupled to the conditioner head for supporting the conditioner head above the polishing pad surface to be conditioned, the support arm having a channel constructed to convey fluid; and a pneumatic driver coupled between the support arm and the conditioner head and constructed to receive fluid through the support arm channel and thereby to apply an actuating force to extend and retract the conditioner head toward and away from the polishing pad surface, whereby an end effector attached to the conditioner head can condition the surface of the polishing pad.

10. The apparatus of claim 9 wherein the driver is coupled between the support arm and the conditioner head to apply an actuating force to the conditioner head from a position that lies along a line that is substantially normal to the polishing pad surface to be conditioned.

11. The system of claim 9 further comprising a fluid line that extends through the support arm to supply rinsing fluid to the polishing pad surface.

12. A method for use in substrate polishing, comprising:

providing a conditioner head constructed to receive an end effector for conditioning a surface of a polishing pad;

supporting the conditioner head above the polishing pad surface to be conditioned with a support arm that extends horizontally over the surface of the polishing pad; and supplying pneumatic pressure through the support arm to a pneumatic driver coupled between the conditioner head and the support arm to apply an actuating force to extend and retract the conditioner head toward and away from the polishing pad surface to enable an end effector attached to the conditioner head to condition the surface of the polishing pad.

13. The method of claim 12 wherein the conditioner head is driven with an actuating force that lies along a line from a position that is substantially normal to the polishing pad surface to be conditioned.

14. An apparatus for use in substrate polishing, comprising:

a machine base;

a rotatable substrate carrier constructed to receive a substrate for polishing;

a rotatable platen mounted on the machine base to support a polishing pad for polishing a surface of the substrate;

a conditioner head constructed to receive an end effector for conditioning a surface of the polishing pad;

a support arm having one end mounted on the machine base and another end coupled to the conditioner head to support the conditioner head above the polishing pad surface to be conditioned; and a driver coupled between the conditioner head and the support arm to apply, from a position that lies along a line that is substantially normal to the polishing pad surface to be conditioned, an actuating force for extending and retracting the conditioner head toward and away from the polishing pad surface, whereby an end effector attached to the conditioner head can condition the surface of the polishing pad.

15. The apparatus of claim 14 wherein the driver is pneumatically-driven.

* * * * *